United States Patent [19]

Bravence et al.

[11] 4,020,589

[45] May 3, 1977

[54] HOOP AND DEVICE FOR "WALKING" SAME

[76] Inventors: Benjamin M. Bravence, 11601 Lenher Schwerin Trail, Tucson, Ariz. 85715; Maurice D. Wilson, 323 N. Norris, Tucson, Ariz. 85719

[22] Filed: Oct. 14, 1975

[21] Appl. No.: 621,962

[52] U.S. Cl. ..... 46/220; 46/47

[51] Int. Cl.[2] ..... A63H 33/02

[58] Field of Search ..... 46/220, 114, 67, 47

[56] References Cited

UNITED STATES PATENTS

| | | | |
|---|---|---|---|
| 1,361,944 | 12/1920 | Whaley | 46/220 |
| 1,499,216 | 6/1924 | Hart | 46/220 |
| 1,936,961 | 11/1933 | Burge | 46/220 UX |
| 2,109,788 | 3/1938 | Worst | 46/47 |
| 3,389,494 | 6/1968 | Blau | 46/220 |
| 3,401,484 | 9/1968 | Anslover | 46/220 |
| 3,708,911 | 1/1973 | Haschek | 46/47 |

FOREIGN PATENTS OR APPLICATIONS

| | | | |
|---|---|---|---|
| 363,801 | 11/1922 | Germany | 46/220 |

*Primary Examiner*—F. Barry Shay

[57] ABSTRACT

A hoop and propelling device usable in the usual manner and also having central radially directed holes on the hoop rim for cooperation with projections on the propelling device. One projection is at right angles to the handle of the propelling device and enables the user to reverse direction of the hoop and also to stop it; the other is aligned with the handle and enables the hoop to be "walked" or spun around the projection.

1 Claim, 11 Drawing Figures

3
2

6
3
6

4
4
5
10
10

5
2B
2B
7
8

9
7
8

HOOP AND DEVICE FOR "WALKING" SAME

This invention relates to toys and in particular, to improvements in Rolling Toys, and more exactly, to Hoop Sticks and Hoops, to wit: Scooter-Hoop. A main object of the invention is to provide a Scooter-Hoop Toy wherein the improvement to the Scooter interact and are dependent on the improvements to the Hoop: thereby, constituting a unit aspect in design improvements for the specific purpose of performing numerous maneuvers.

A further object of our invention is to provide a combination Scooter and Hoop Toy whereby to Scooter and Hoop improvement features can be employed, one to the other, each dependent on the features of the other, so that the Hoop can be propelled along a line of travel whereby the improved design features of the Scooter can be directed to the improved design features of the Hoop, thereby maximizing extremely accurate control of turning, spinning, lifting, starting, stopping, or reversing directions, and more importantly, that these maneuvers can be performed, as a feature of improvements to both the Scooter and Hoop, at a very slow speed of forward travel, to include standing in one place as manual coordination, dexterity, and individual inventiveness interact.

FIG. 1A is a perspective view showing handgrip, shaft, and cross member with nodules and hooked ends.

FIG. 1B through 1E show details of the hoop stick, in which:

- Numeral 2 is the shaft of the Scooter.
- Numeral 3 is the handgrip portion of the Scooter.
- Numeral 4 is the hook end of the Scooter cross members.
- Numeral 5 is the Scooter cross member showing the underside nodule.
- Numeral 6 is of the Scooter cross member showing the forward nodule.
- Numeral 10 shows the cross member feature of the improved Scooter.

Figures 1A, 1B, 1C, 1D, 1E, 2A, 2B:
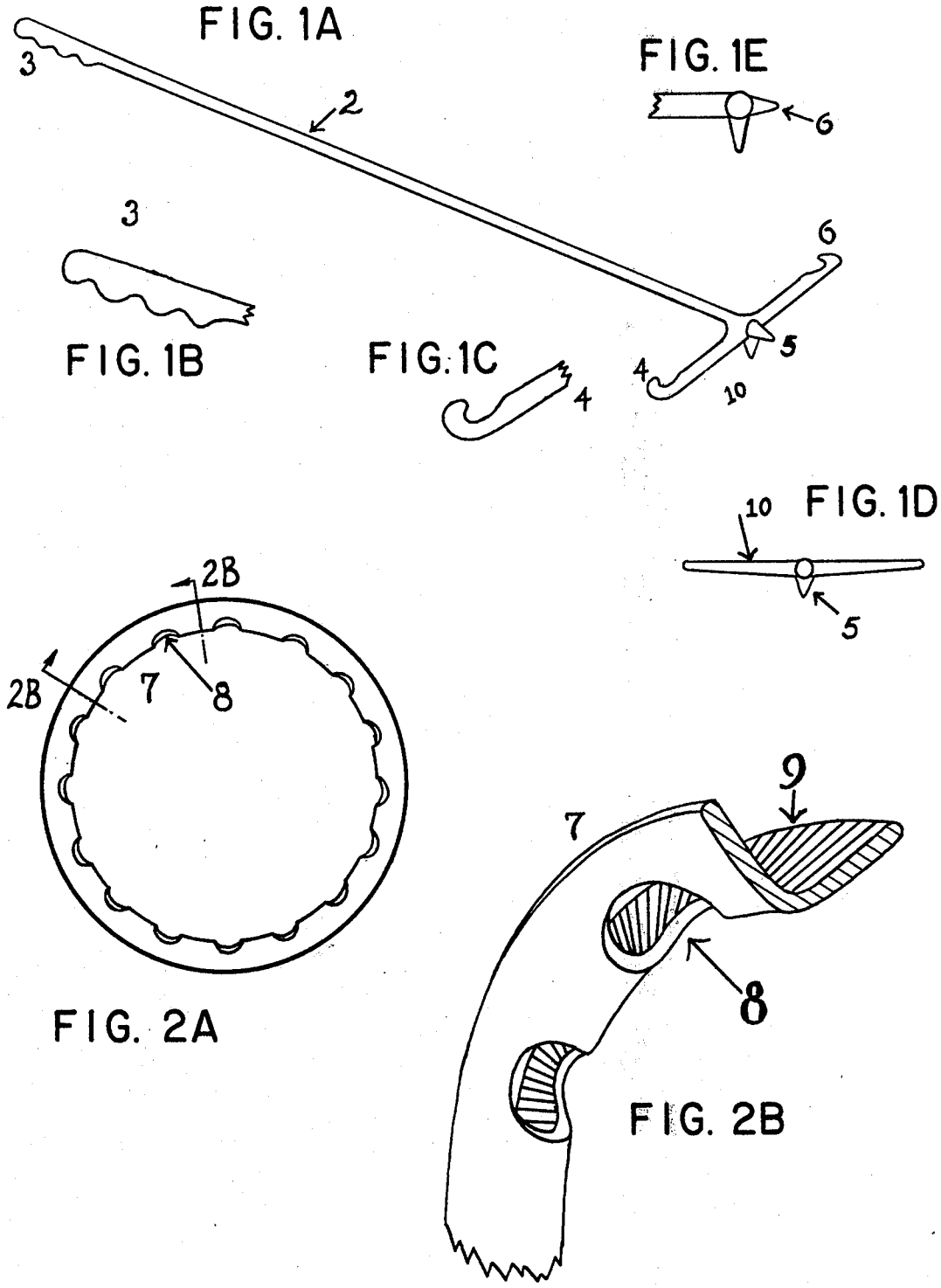

FIG. 2A is a side view, and FIG. 2B shows a fragmentary portion taken between lines 2B— 2B of FIG. 2A, with one end in cross-section, of our improved Hoop.

- Numeral 7 is the fragmentary portion showing the general desing features of the improved Hoop.
- Numeral 8 designates the equally spaced holes around the diameter of the Hoop.
- Numeral 9 designates a closeup of the "V" groove design feature.

Figure 3:
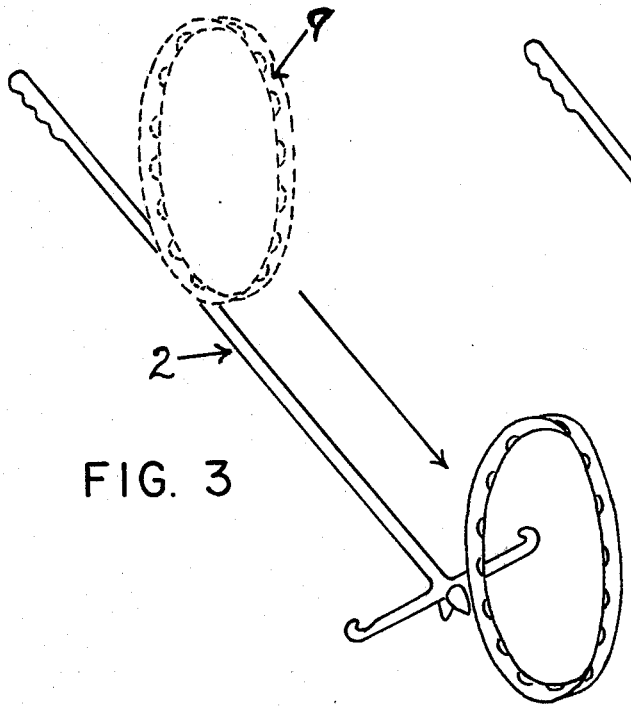

FIG. 3 is a perspective view of Scooter and Hoop depicting the slow starting position and resulting action.

Figure 4:
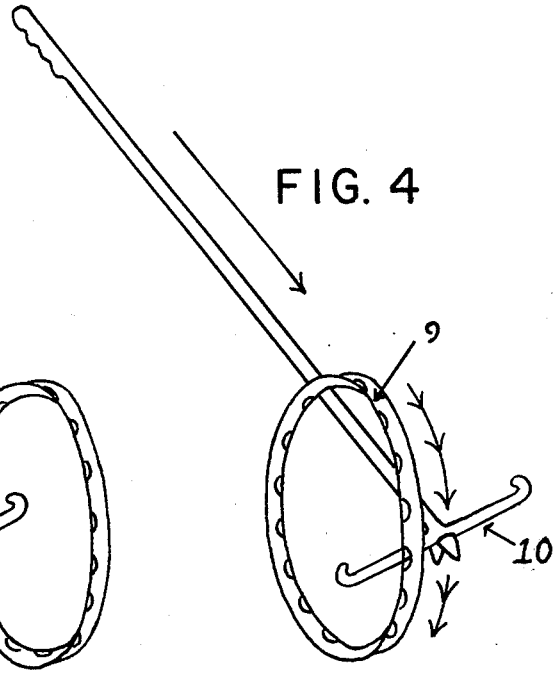

FIG. 4 is a perspective view of Scooter and Hoop depicting the fast starting position and resulting action.

Figure 5:
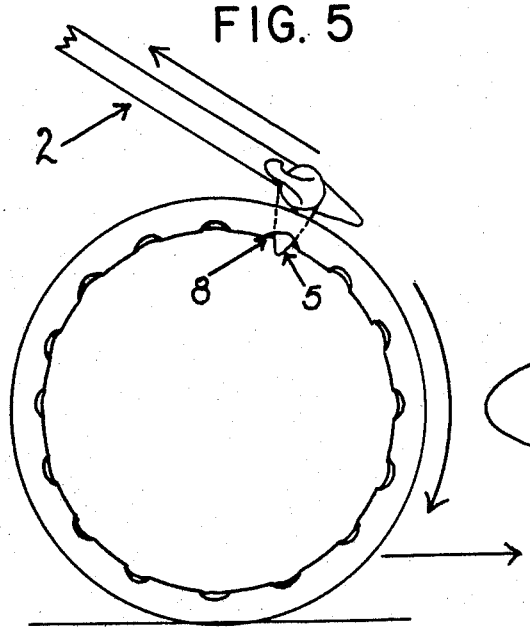

FIG. 5 is a side view of the Scooter cross member, with nodules, and the Hoop, showing Scooter underside nodule being employed in one of the Hoop holes for maneuvering purposes.

Figure 6:
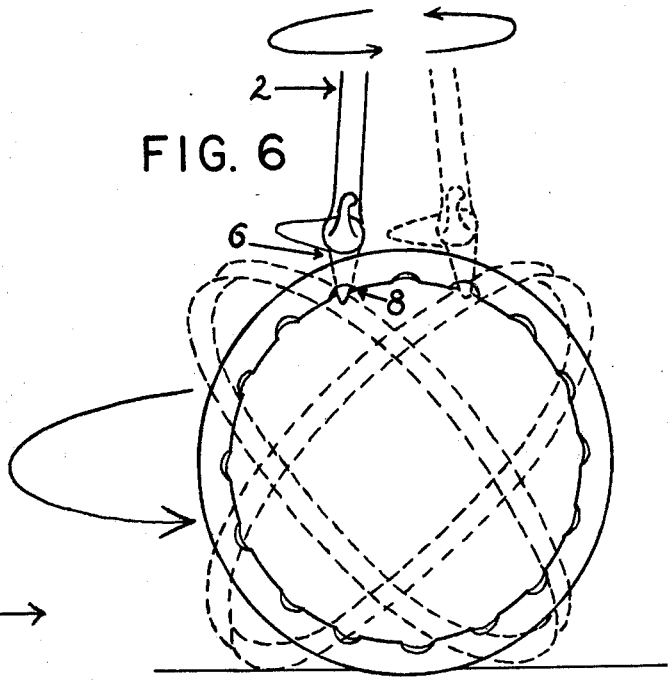

FIG. 6 is a side view of Scooter cross member, with nodules, and Hoop, showing Scooter forward nodule being employed in one of the Hoop holes for maneuvering purposes. Referring to the drawings and more particularly, to FIGS. 1A and 2A. The improved Scooter in FIG. 1A comprises a unit that will preferably be formed of molded plastic tubing and will be cylindrical throughout. It will have a handgrip 3 that is a molded integral part of the total unit as will be the hook 4 and nodules 5 and 6.

FIG. 2A comprises a side view with exploded section 7 of the improved Hoop. The Hoop will preferably be made of a formed plastic material. It will have a v groove 9 to afford it stability, both in construction and use, as well as equally spaced holes 8 to be employed during certain maneuvering phases.

In operation, referring in particular to FIGS. 3, 4, 5, and 6. FIGS. 3 and 4, illustrate two starting modes, slow and fast.

FIG. 3, shows the Hoop FIG. 2A and v design groove 9 being fit to the shaft 2 of the Scooter held at an incline angle to a surface. The shaft 2 of the Scooter providing a runway for starting the Hoop FIG. 2A in a forward path of travel, gravity being the locomotive force for movement of the Hoop FIG. 2A down the shaft 2 of the Scooter, constituting a slow start.

FIG. 4, shows the Hoop FIG. 2A standing still. This is accomplished by the stability of the v groove design feature 9. For fast starting purposes, the Scooter FIG. 1A cross member 10 is applied to the inside of the Hoop with a sharp forward movement of the Scooter shaft 2. Locomotion is instantaneous, constituting a fast start.

FIG. 5, shows the Scooter FIG. 1A underside nodule 5 being employed within one of the Hoop FIG. 2A holes 8 for the purpose of stopping and/or reversing direction of travel. During forward motion, underside nodule 5 of Scooter FIG. 1A can be allowed to drag in the revolving holes 8 of the Hoop FIG. 2A, thereby constituting a slowing motion. When forward motion has ceased with v groove design feature 9 supporting Hoop, nodule 5 can be placed in Hoop hole 8 and a sharp pulling motion of Scooter shaft 2 will necessitate a reversal of direction.

FIG. 6, shows the Scooter FIG. 1A forward nodule 6 being employed within one of the Hoop (FIG. 2A) holes 8 for the purpose of performing spinning type maneuvers. When forward motion has ceased, with V-groove design feature supporting Hoop, nodule 6 can be placed in Hoop hole 8 and shaft 2 of Scooter FIG. 1A can be manually moved in concentric circles along its entire length, resulting in the Hoop moving in a spinning or "walking" maneuver.

Furthermore, inventiveness is the essence of improved design features.

We attach great importance to the fact that our improved Scooter-Hoop Toy stresses inventiveness, and supports and aids, through its improved design features, a person to acquire considerable skill, with a large number of skillful maneuvers being possible, as physical and mental elements interact.

We claim:

1. A toy comprising a generally circular hoop having a generally V-shaped groove about its entire periphery, the sides of the V-shape diverging in a direction radially outwardly of said hoop to form edges on which said hoop may stand or roll on a supporting surface, the center of said groove having at least one hole therein through said periphery; a drive member comprising an elongated shaft having a handle at one end and a cross member joined thereto at the other end, said cross member extending transversely of the length of said shaft and having means thereon for coacting with the edges of said hole for maneuvering said hoop, said means comprising at least one nodule projecting from said cross member generally in the direction in which said shaft extends and at a location opposite the joint with said shaft, said nodule being relatively short, whereby said drive member maybe used to propel said hoop by rolling it over the ground by means of said cross member or by placing said nodule in said hole with the hoop standing on the ground and moving said hoop with said drive member in a spinning or "walking" maneuver.

* * * * *